US006210461B1

(12) United States Patent
Elliott

(10) Patent No.: US 6,210,461 B1
(45) Date of Patent: Apr. 3, 2001

(54) CONTINUOUS PRODUCTION OF TITANIUM, URANIUM, AND OTHER METALS AND GROWTH OF METALLIC NEEDLES

(76) Inventor: Guy R. B. Elliott, 4515 Stockbridge Ave. NW., Albuquerque, NM (US) 87120-5419

( * ) Notice: Subject to any disclaimer, the term of this patent is extended or adjusted under 35 U.S.C. 154(b) by 0 days.

(21) Appl. No.: 09/132,067

(22) Filed: Aug. 10, 1998

(51) Int. Cl.[7] ..... C22B 60/02

(52) U.S. Cl. ..... 75/344; 75/368; 75/399; 75/619; 75/621; 75/622; 75/623

(58) Field of Search ..... 75/399, 619, 621, 75/622, 623, 585, 344, 368; 420/590

(56) References Cited

U.S. PATENT DOCUMENTS

| | | | | |
|---|---|---|---|---|
| 3,067,025 | * | 12/1962 | Chisholm | 75/619 |
| 5,259,862 | * | 11/1993 | White et al. | 75/617 |
| 5,421,855 | * | 6/1995 | Hayden, Jr. et al. | 75/399 |

FOREIGN PATENT DOCUMENTS

| | | | | |
|---|---|---|---|---|
| 2-185931 | * | 7/1990 | (JP) | 75/619 |

OTHER PUBLICATIONS

Loeb, L. B. Fundamentals of Electricity and Magnetism 1947 John Wiley & Sons pp. 137–149.

* cited by examiner

*Primary Examiner*—Melvyn Andrews

(57) ABSTRACT

This invention provides improved production, continuous or batch, especially of metals which have been produced by versions of the Kroll and Ames processses. This list includes titanium, zirconium, hafnium, vanadium, niobium, tantalum, rhenium, molybdenum, tungsten, and uranium. It also offers a process for growing particular shapes of metallic crystals, e.g., needlelike. This invention is intended to be less expensive to operate and to provide a superior product than from Kroll batch processing, as often used: For the continuous metal production, circulating molten salt supports two principal reaction stages, which together allow continuous metal production: Titanium powder production with one possible set of reactants may be used as an example for the group of metals listed: In Stage 1 a pumped solution of titanium ions ($Ti^{++}$) dissolved in molten salt (e.g., $MgCl_2$—KCl) flows onto, then down beside, molten magnesium that floats on molten salt below. Titanium ions in molten salt pass molten magnesium and grow titanium crystals, which settle in the salt and are mechanically removed. In Stage 2, solutions of titanium ions are regenerated in the circulating molten salt by reaction of $TiCl_4$ and titanium powder. The circulation allows Stages 1 and 2 continuous reactions to proceed simultaneously in different regions of the circulating system. For the crystal growth, single stage operation is described. $UF_6$ can also be used.

52 Claims, 3 Drawing Sheets

CONTINUOUS PRODUCTION OF TITANIUM, URANIUM, AND OTHER METALS AND GROWTH OF METALLIC NEEDLES

REFERENCES CITED

| U.S. Documents | | | |
|---|---|---|---|
| 5,421,855 | 6/6/1995 | Hayden et al. | 75/393 |
| 4,552,588 | 11/1985 | Elliott | 266/87 |
| 5,259,862 | 11/1993 | White, et al. | 75/363 |
| 60/055690 | 8/13/97 | Elliott | CIP of |

BACKGROUND OF THE INVENTION

This invention relates to improved processing for continuous or batch production of a metal or alloy from one or more compounds of that metal. Usually a halide compound dissolved in molten salt reacts with molten magnesium floating on molten salt. The invention was specifically designed for titanium production but use of the process is expected also for other metals, especially those for which Kroll is used, either as calcium reductions of oxides or magnesium reductions of halides.

Depending on conditions these products may be formed as metals or alloys, liquids or solids. Chemical and physical guidance of product formation may lead to structures including crystalline powder, powder agglomerates, and single crystal needles in various sizes. Such production has economic value in lowered costs relative to present production, in improved metal product quality, in supplying special needs, and in safer and environmentally improved operations, as compared with production by variations of the Kroll and Ames processes, e.g., respectively titanium or uranium.

An example of special needs is metallic needles for metal-organic composites for automobile panels. In using the present invention, the production of crystals of a metal involves the reduction of one or more compounds of that metal dissolved in a molten salt phase. With proper conditions for a given metal, it may be possible to grow needles or other useful shapes of that metal using the invention.

Prior Art:

Word Usage:

Commercial terms used regarding the Kroll process in various forms, e.g., in titanium production, are in some ways confusing. The industry's term "sponge" may be used more or less interchangeably with "powder" for describing the original Kroll process product, which may resemble a dirty clinker, and also for describing derivatives from the original product that form after crushing the process product and after cleaning it.

Usage in this disclosure may include identifying terms like "Kroll sponge" for the uncleaned product and "cleaned Kroll sponge" after substantial removal of the reaction by-product. Fine particles of metal product from this invention may be described by general terms: powder (with individual particles often made up of many small crystals); crystals (with various shapes depending on which faces of a crystal grew); and needles (often single crystals deposited electrolytically as the metal was forming during reduction of ions of the metal).

Older Related Art in Production of Titanium and Other Metals:

Kroll:

Conventional commercial production of titanium almost entirely utilizes pressure vessels for erratic, one-stage, Kroll batch reductions: For example, titanium tetrachloride ($TiCl_4$) as gas, and excess molten magnesium metal react in a sealed reduction vessel at about 800–1000° C. to form titanium "sponge." Reactions such as excess calcium with $ZrO_2$ to form zirconium sponge and CaO have also been used widely in Kroll form. These reactions typically yield rather poor, expensive, often hazardous products that may, or may not, be suitable to clean to an adequate product. Many metals can be made in batch versions of this process, however.

In particular, the Kroll sponge is agglomerated metal particles that, when cooled, hold trapped by-products, such as magnesium chloride, excess magnesium, and impurities, e.g., magnesium oxide, $TiCl_2$, and other metals. The acid and water washes originally used for Kroll cleaning are now inadequate. Much of the Kroll reduction by-product content can be removed by high-temperature vacuum distillation from the relatively nonvolatile titanium; later alloy melting can settle out some impurities and stir the melt.

Kroll and this Invention:

Metallic scrap or products of Kroll-type reductions might be recycled or purified by use in the invention of this application. Such treatments might increase the overall U.S. rate of quality product metal formation, as well as providing a way in which otherwise effectively unremovable impurities could actually be removed—both treatments have economic value.

This usage has not been taught previously, and it is an unobvious application of the present invention.

Ames:

The Ames process has been used for most production of uranium: In one-stage batch reductions, magnesium reacts with $UF_4$ (not a gas) at about 1400° C. to form molten uranium. It is recognized that Ames processing should be replaced.

Elliott, et al., Uranium; Replacing the Ames Process:

The first continuous molten salt-molten metal processing by metallothermic reduction for molten uranium or its alloys was invented by Elliott, U.S. Pat. No. 4,552,588, the present inventor, and coworkers at his laboratory, intermittently using Federal and private funds. This work was especially for depleted uranium tank armor but also for other needs. (Ames is batch only.)

Further development and demonstration at Elliott's laboratory and at Oak Ridge National Laboratory led to an improved form as taught in U.S. Pat. No. 5,421,855 for use with enrichment of natural uranium for commercial nuclear electric power This older invention cannot handle volatile reactants like $UF_6$; it is single stage, like Ames, and it requires low volatility reactants like $UF_4$ and $UCl_4$.

Earlier Alternatives to Kroll:

Hunter electrolysis was long used for titanium production, but in the U.S. it proved non-economic relative to Kroll and was shut down. Sodium reductions can provide excellent titanium but are too expensive for all but small markets and are mostly done outside of the U.S. Other approaches to titanium production include an early iodide decomposition process, newer approaches including Japanese electrolysis (which may become commercial), plus high temperature vapor reductions, and dehydriding.

$TiCl_2$, an intermediate used in the present invention, is also an intermediate with Hunter and in sodium reductions;

however, techniques to form and use the $TiCl_2$ are not obviously related to the present invention.

Current Related Art:

Continuous Stirred Tank Reactor (CSTR) to Improve over Kroll:

White, et al., U.S. Pat. No. 5,259,862 invented a second continuous approach (CSTR) to continuous metallothermic production of metal (after U.S. Pat. No. 4,552,588). That system is now moving toward commercial usage.

U.S. Pat. No. 5,259,862 dissolves sodium or other reductant metal into molten salt, and mixes that salt with another solution that holds suspended titanium and has $TiCl_4$ vapor bubbling up. It operates at approximately steady state with $TiCl_4$, $TiCl_2$, Ti, and dissolved sodium, all in the same stirred bath. Technically it is one-stage because it is one big bath, but it also provides regions where various steps go on.

U.S. Pat. No. 5,259,862 and This Invention:

U.S. Pat. No. 5,259,862 appears to this inventor to have an economic future in rough parallel, though apparently not as broad usage, as the future for this present invention. The two appear to be complementary in satisfying industrial needs.

Although dissolved magnesium is claimed for use in U.S. Pat. No. 5,259,862, sodium is presumably the obvious choice for reductant metal, with magnesium marginal at best there. In contrast, magnesium is generally the preferred reductant with the present invention; it operates with a magnesium as a second phase.

Magnesium Reduction of $TiCl_4$, and Other Species to Replace Kroll:

Although uranium equipment claimed in U.S. Pat. No. 4,552,588 has been around for 12 years and was adapted (U.S. Pat. No. 5,421,855) for use with AVLIS uranium enrichment, it was not obvious to this inventor or to those versed in the art, that U.S. Pat. No. 4,552,588 had relevance for production of Ti from $TiCl_4$.

Two-Stage Magnesium Reduction of $TiCl_4$ to Replace Kroll Reductions:

To arrive at an alternative production approach that will correct Kroll's problems, it is first useful to analyze the Kroll reaction:

$$TiCl_{4(g)}+2Mg_{(l)}=Ti_{(s)}+2MgCl_{2(l)} \quad (1)$$

Please note the following facts: (a) The $MgCl_2$ by-product wets and coats the molten magnesium. (b) $TiCl_4$ gas does not dissolve in molten $MgCl_2$. (c) $MgCl_2$, therefore, obstructs the main reduction reaction, Eq. 1.

To solve this incompatibility problem, this invention offers two reaction stages operating smoothly in a molten-salt medium: In one stage (named Stage 2) $TiCl_4$ is formed in a solution of molten salt; unlike $TiCl_4$, the $TiCl_2$ dissolves readily in the molten salt. The chemistry is discussed later.

In another stage (named Stage 1) $TiCl_2$ in molten salt reacts with magnesium floating on molten salt to form the products of Eq. 1.

The invention of Stage 2 is new and unobvious, and new equipment concepts had to be devised. Concepts similar to earlier uranium equipment were also adapted to Stage 1: however, the equipment for connecting Stage 1 and Stage 2 and for continuous cycling of the molten salt are all new. Also, the means of removing the product by a screw mechanism, and the by-product $MgCl_2$ on a cool probe, are both new.

The present invention teaches two new aspects of continuous metal production: (i) It teaches two stage reductions in one continuously operating system for continuous formation of metal product forms, e.g., as molten or solid metals or alloys. (ii) It teaches regarding ways to control chemical and physical conditions that also can lead to guidance of formation of particular solid forms, e.g., crystal needles.

Thus reductions with only Stage 1 are adequate for the earlier usage (U.S. Pat. Nos. 4,552,588 and 5,421,855) because ionic $UCl_4$ or $UF_4$ would not boil away during the reduction. Stage 2, however, is required for chemical behavior like that of $TiCl_4$ of this invention, and it leads to new claims that give an improved process over that taught and claimed by Hayden U.S. Pat. No. 5,421,855 and other Elliott patents.

This two stage improvement on earlier teaching appears to solve titanium problems that have been recognized for at least 30 years.

Also, a problem of continuous $UF_6$ to U conversion may be soluble by similar treatments following this invention as some 600,000 metric tons of depleted $UF_6$ by-product are brought from outdoor Federal storage and into appropriate control.

Additionally, the commercial value of producing needle-like crystals, possibly single crystals, of titanium or of other metals or alloys was not taught earlier: Elliott U.S. Pat. No. 4,552,588 notes that, when molten salt that includes dissolved uranium ions is in contact with molten magnesium at temperatures below the uranium melting point, there form "small crystals of solid uranium which sink and form small uranium droplets" in hotter regions of the uranium production system.

However, it was not taught that physical and chemical control of the reaction offered a potential method of producing useful needle-like crystals of pure uranium. Again, this is an unobvious method of forming metallic crystals, especially needle-like crystals.

Therefore, this disclosure now claims controlling physical and chemical conditions so as to guide the preparation of desired shapes, e.g., small crystals, single crystals, or both, of a desired metal by reduction of dissolved ions under particular chemical and physical conditions.

SUMMARY OF THE INVENTION

Objects of the Invention:

Major Object 1:

Existing technology for production of titanium is by the Kroll process, which is inadequate in many ways. Most of Kroll's titanium problems arise because gaseous Ti and molten magnesium must get together to make titanium, but they react visciously and in spurts, leading to impure products that are hard to clean up.

The main object of this invention was to find a way, which was found, to get smooth, environmentally sound, economical reactions to produce titanium metal. The approach is to form a reaction intermediate which can form smoothly, then, also smoothly, complete the reaction, thus getting a clean product and a well-behaved engineering system.

This invention adapted part of its technology from earlier inventions by this inventor for uranium (U.S. Pat. Nos. 4,552,588, 5,421,855).

This invention appears to have wide potential use with numerous metals.

Major Object 2:

Existing uranium technology designed for continuous metallothermic reduction (CMR) of uranium (U.S. Pat. Nos. 4,552,588, 5,421,855) is unsuited for direct reduction of volatile $UF_6$. Therefore, an intermediate reduction of $UF_6$ to $UF_4$, usually by hydrogen reduction, has been required before CMR, and also before usual Ames process reductions.

Reductions of some major part of 600,000 tons of U-235-depleted $UF_6$ (stored in fields open to the weather) to uranium metal or alloy are planned, especially for environmental reasons. It would be highly beneficial if the reductions could be carried out directly by CMR, thus avoiding setting up special facilities for the hydrogen reductions to $UF_4$ near the storage fields.

This invention, if included as a stage of the CMR system for depleted $UF_6$, would avoid the hydrogen reduction facilities, effect related important cost savings, and avoiding unnecessary transport of radioactive and hazardous (HF) materials.

Major Object 3:

Technology for use of CMR (U.S. Pat. Nos. 4,552,588, 5,421,855) in forming metallic needles, more massive powders, and other special shapes does not exist in the open literature. However, the need for metal needles is growing, e.g., for composite materials with plastics.

The inventor has produced uranium whiskers using CMR in privately funded research in his laboratory. Analysis of these in-house uranium results has led to the invention of techniques to be used in growing metallic needles, and this has become a third major object of this invention.

DETAILED DESCRIPTION OF THE INVENTION

Preferred Embodiment 1, Continuous Two-Stage Production of Titanium:

This invention is offered to be less expensive to operate and to provide a superior product than Kroll batch processing, as often used: Titanium powder production was the original object of this invention, and it is described alone here because it is best known to the inventor, and titanium usage is planned to be first developed.

Usage of Terms "Stage 2" and "Stage 1":

This invention uses a cycling molten salt phase (e.g., KCl—$MgCl_2$) acting as a carrier of reactants, reaction intermediates, products, and by-products. Word usage is to speak of "Stage 1" as the product formation stage; likewise "Stage 2" is where reaction intermediates (e.g., $TiCl_2$) are chemically prepared for product formation.

Although this usage may be slightly awkward in a patent, it is too late and inappropriate to change the term usage now.

Figure 1:
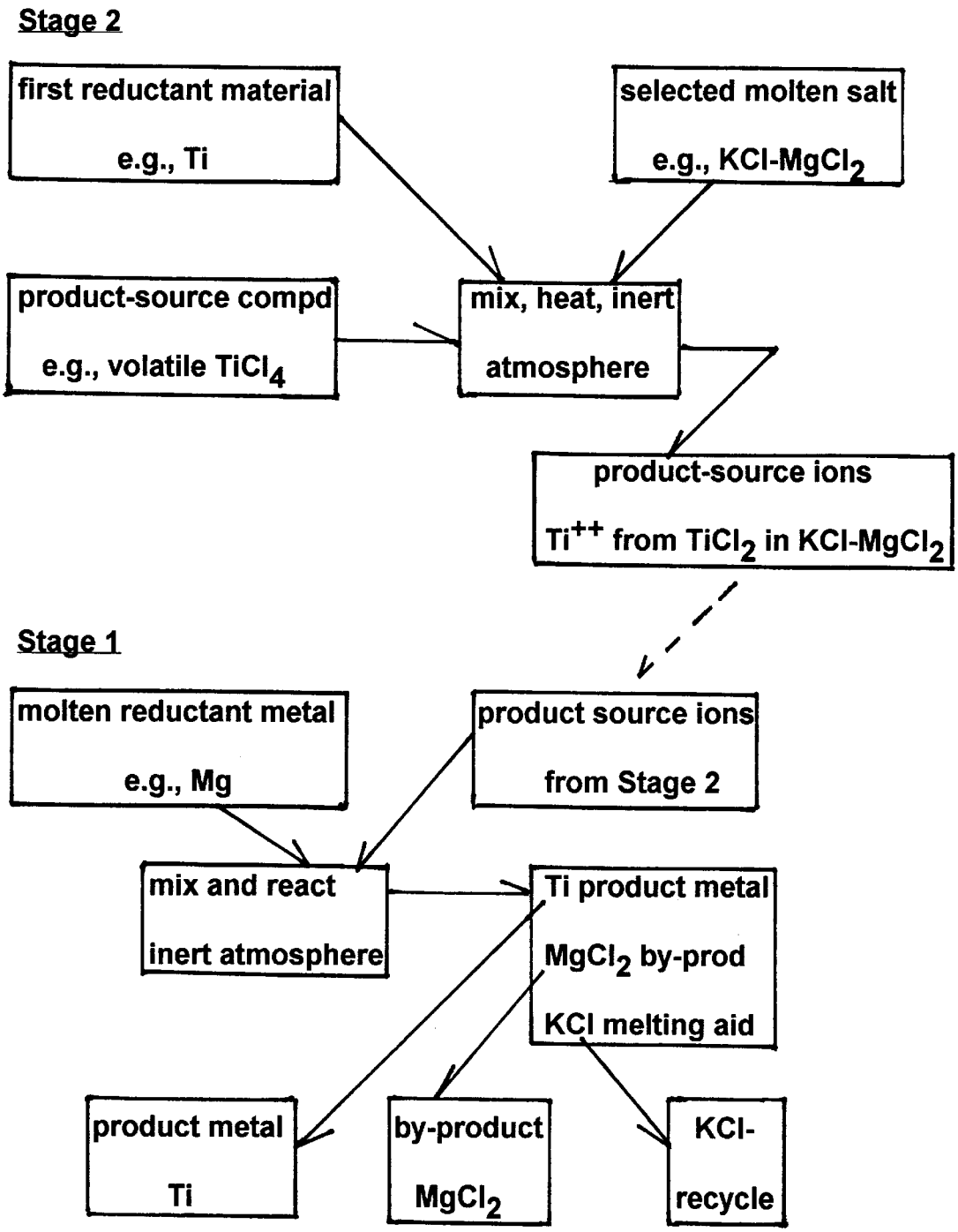
FIG. 1 is an abbreviated open-flow sheet for the continuous production of titanium metal and explains terms used in claim 1. It shows the present invention in continuous, once through, operation.

FIG. 1 is a brief description of the reaction stages as a (usually) volatile product source compound is converted into a desired product metal. The process may be operated in batch or continuously. The continuous flow may be once through with major separations of product and by-product outside of the heated region. Alternatively, the product and the by-product may be largely separated within the furnace system with the molten salt phase retained after separation individually of product metal and by-product out of the hot system.

In FIG. 1, Stage 2 provides a volatile product-source compound. Here $TiCl_4$ is chosen. Alternative choices might include volatile, higher-valence halides of zirconium, hafnium, vanadium, niobium, tantalum (e.g., $TaCl_5$), rhenium, molybdenum, tungsten, of uranium (e.g., as $UF_6$).

Likewise, a first reductant material is provided. This usually will be the product element provided in metallic form (zero valence), supplied either from earlier product (for a very pure desired product) or from impure or recycled material or a Kroll sponge. Other reductant materials might be used, e.g., hydrogen.

Here titanium is provided, and the listed elements above, and others, might be used similarly. Later reduction will give the added titanium back in purified form, along with new titanium derived from the $TiCl_4$.

A molten salt phase, as chemical carrier and catalyst, is provided. It assists formation of dissolved product-source ions and, later, allows reactions that form the desired product metals. Often it will be made up, at least in part, of elements from Periodic Table Groups IA and IIA. Also, halides will be included. KCl—$MgCl_2$ are used here, but KF—$MgF_2$ can also be valuable, e.g., with $UF_6$.

The metals acting as first reductant materials and the vapors of the product-source compounds do not react smoothly alone, but the presence of the molten salt phase allows electrochemical reactions that assist formation of product-source ions in molten salt solution. The molten salt solutions thereby can provide the dissolved product-source ions (here $Ti^{++}$ from $TiCl_2$) required for reduction to the desired product metals indicated above, or others. The reaction for titanium production is:

$$Ti_{(s)}+TiCl_{4(g)}=2TiCl_{2(in\ molten\ salt)} \quad (2)$$

In FIG. 1, Stage 1, molten salt phase carrying product-source ions joins molten reductant metal. Here, magnesium is the metal, but the list is more general, including elements from the group IA, IIA, aluminum, and zinc. The reaction produces desired product metal, here titanium, but other metals already indicated as product source ions could also be formed.

$$2TiCl_{2(soln)}+2Mg_{(l)}=2MgCl_{2(soln)}+2Ti_{(s)} \quad (3)$$

The metal may come in several forms: The pure metal may be as powder or small crystal grains, including as needles. The crystal forms may be enlarged, e.g., by repeated passage through the Stage 1 reaction zone. The product may be molten or solid. It may be alloyed as melt or solid, e.g., by passing alloying elements along with the forming desired product metal in Stage 1. Joint reduction of more than one product ion is possible.

The form of the product, e.g., as crystalline titanium needles or as other shapes, may be influenced by the physical and chemical nature of the reaction.

The metal product may be protected by leaving an outer layer of molten salt frozen on it. The salt film may be removed by vacuum evaporation at elevated temperature. Alcohol or other solvent may wash the metal clean.

Here the by-product may be removed from the molten salt by lowering the temperature and allowing it to freeze out, e.g., along a phase diagram liquidus line.

Formation of product-source ions may be used as a purification technique both for impurities from the product-source compounds and from impurities in the reductant material: Consider $TiCl_4$ with $FeCl_3$ impurities that had also vaporized as the $TiCl_4$ was being "purified." When the $Fe^{+++}$ ions contact the region where $Ti^{++}$ ions (from $TiCl_2$) exist in contact with excess Ti metal, the molten salt becomes an impenetrable barrier for Fe ions—$Fe^{+++}$ and $Fe^{++}$ will quickly be reduced to metal, and $Ti^{++}$ ions will form in place of the other ions. Likewise, other iron impurities from recycled metal will be stopped by the barrier. This sort of restriction will hold for all the metals suggested as product metals, so long as the impurities as ions are less stable thermodynamically than the product-source ions, assuming these ions are in equilibrium with their product metal.

The composition of the selected molten salt can be important by increasing the solubility of product source ions in the molten salt phase. For example, the use of KCl in the molten salt phase may increase the solubility of $TiCl_2$ in KCl—$MgCl_2$ by allowing formation of soluble complex species derived from $KCl.TiCl_2$ or $2KCl.TiCl_2$, which dissolve the molten salt.

Figure 2:
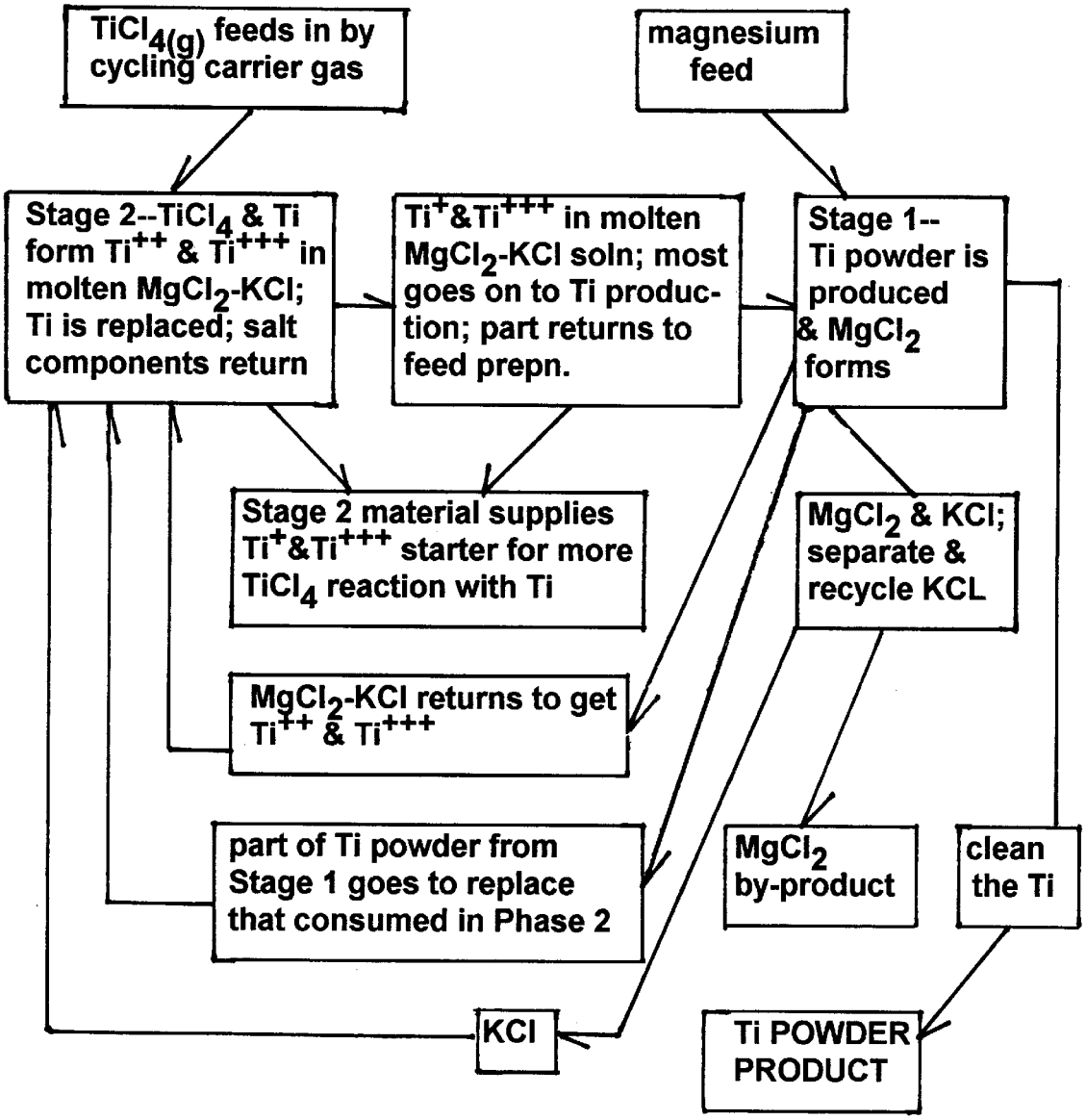
FIG. 2 is a drawing of a preferred embodiment of the process of continuous production of titanium by this invention using continuous recycle of the flowing molten salt phase. Similar usage could apply for production of numerous other metals.

The FIG. 2 flow sheet describes the continuous production of titanium following this invention. Similar reactions may be possible with numerous other chemical elements, e.g., those already pointed out.

Summarizing this flow sheet, in Stage I a pumped solution of $Ti^{++}$ ions dissolved in molten salt (e.g., $MgCl_2$—KCl) flows onto, then down beside, molten magnesium that floats on molten salt below.

As titanium ions in molten salt pass the molten magnesium, they grow titanium crystals which settle in the salt, are mechanically removed, and are cleaned to yield titanium product.

Still summarizing in Stage 2, solutions of titanium ions are regenerated in the circulating molten salt by the combination of $TiCl_4$ and titanium powder under reactive conditions. The circulation allows Stages 1 and 2 continuous reactions to proceed simultaneously in different regions of the circulating system.

The process is carried out in an inert atmosphere, e.g., in a glove box and using thermodynamically or kinetically suitable ceramic or metallic containers.

As described above, Stage 2 is discussed before Stage 1 for patent purposes.

Stage 2: Formation or Regeneration of Ti Ions in Molten Salt Solution:

Referring to FIG. 2, a reaction region different from that of Stage 1 is used to regenerate $Ti^{++}$ cycling in molten salt solution as part of a process for forming titanium metal product, as in Eq. 2.

In the Stage 2 region, following the arrows: (a) A source of $TiCl_4$ reactant is as $TiCl_4$ in carrier gas is provided three things: (a) A source of titanium tetrachloride reactant is provided; this reactant may be as $TiCl_4$ gas plus a carrier gas is fed into the Stage 2 region. Also in this case, (b) titanium metal in excess to react with the $TiCl_4$ is supplied from part of the titanium powder product powder in Stage 1. Often the titanium will be as powder. The reaction produces $Ti^{++}$. Titanium is mechanically added to Stage 2. (c) A molten salt solvent for $Ti^{++}$ circulates through the system (follow the arrows) and provides a medium for the reaction to form the $Ti^{++}$ and also serves as a carrier to get the $Ti^{++}$ to Stage 1 reaction. Here $MgCl_2$—KCl is a preferred choice—the $MgCl_2$ is a product from magnesium reductions, and the KCl both increases the solubility of titanium ions and lowers the melting point of $MgCl_2$.

The added titanium metal settles to the bottom of the molten salt, and the $TiCl_4$ in carrier gas is bubbled into the bottom region. However, both the metal and the gas are not in the molten salt phase, and here the electronic conduction of the metal becomes important, because tiny electrochemical cells are set up. These cells allow reaction at a small distance between $TiCl_4$ (touching outside of the salt) and Ti metal reactant (coated by salt) with the Ti metal being both an electronic conductor and a reactant.

There remains a problem of having enough Ti ions in the solution to permit the tiny cells to drain. Here the Stage 1 reductions (to be discussed) will be expected to substantially eliminate the Ti ions. Therefore, it may be necessary to resupply some $Ti^{++}$ (or $Ti^{+++}$ ions) to the Stage 2 reaction region, because the Ti ions are required for ionic conduction, to complete the tiny cells above and get the reactants together.

Therefore, as shown in the box to the right of Stage 2, a small amount of the Stage 2 product ions in molten salt is diverted directly back to add Ti ions: this is as reaction starter material to the Ti-ion-depleted molten salt returning from the Stage 1 production of Ti metal. This diversion assures that Ti ionic electrical conductivity can also occur and allow the tiny cells to catalyze rapid reaction to put Ti ions into solution.

In Stage 1, magnesium floating on molten salt phase reacts with incoming $Ti^{++}$ in molten salt forming titanium powder and producing $MgCl_2$ by-product. Magnesium is added as needed.

Following the arrows, the titanium product of Stage 1 settles and is removed mechanically, then cleaned, giving the desired product metal.

The by-product is removed, here by draining off enough $MgCl_2$—KCl to remove the by-product $MgCl_2$. Then the KCl and by-product are separated with the KCl going back to Stage 2 and the $MgCl_2$ going to by-product.

Alternatively, the by-product may be removed from the molten salt by lowering the temperature locally and allowing the $MgCl_2$ to freeze out, e.g., along thermodynamic phase diagram liquidus surfaces. The cold material on which the $MgCl_2$ freezes out can be removable for by-product collection.

Figure 3:
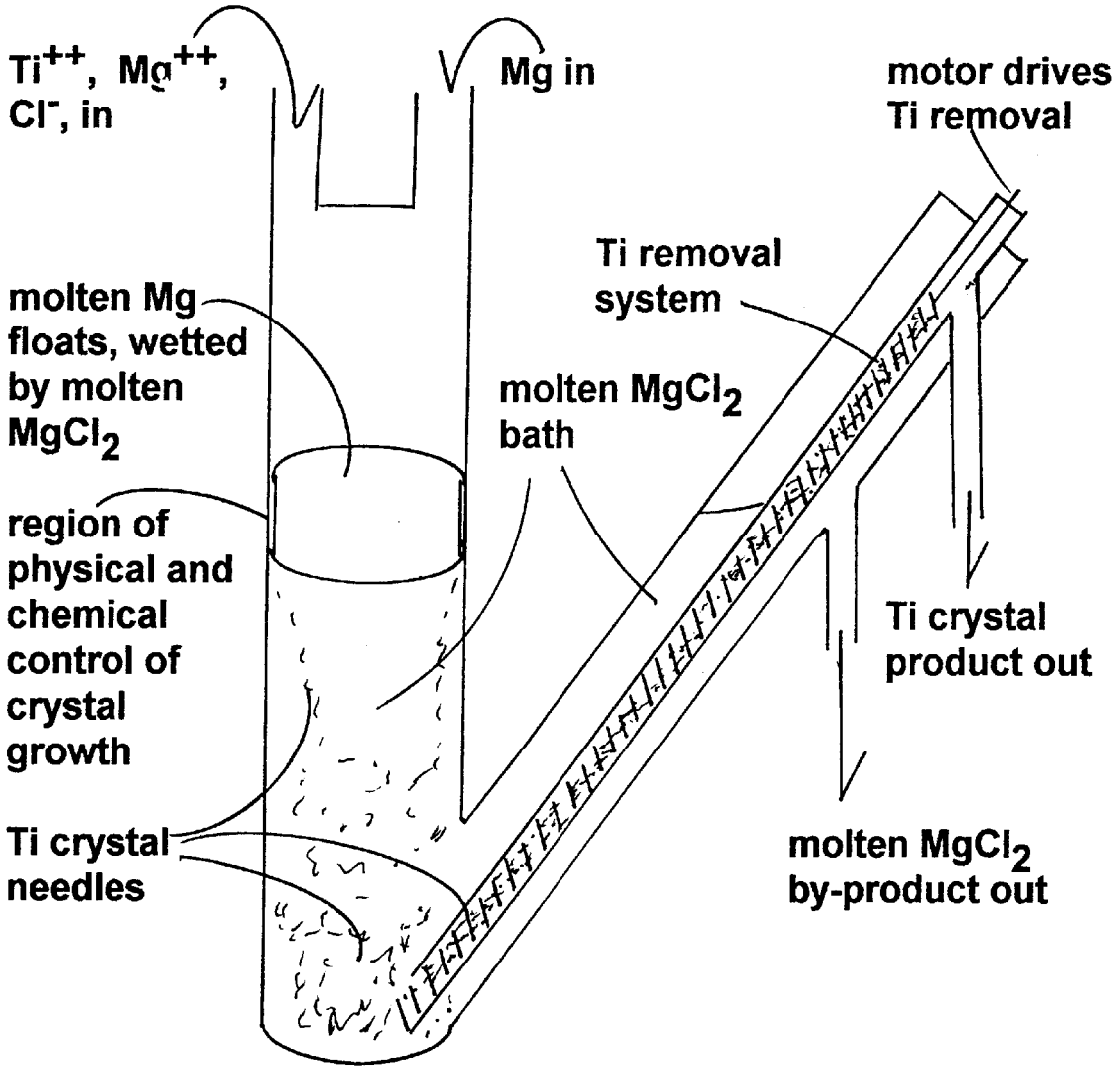
FIG. 3 is a drawing of a preferred embodiment for forming needle-like crystals of titanium in molten salt, separating out the needles, and recycling or disposing of by-products. This practice is adaptable for single crystals of other metals.

Preferred Embodiment 2, Metallic Needle Formation: FIG. 3 shows a preferrred embodiment for growing special, desired, crystal shapes (not crystal structures) of various metals. As an example, FIG. 3 describes titanium production.

Here, a product-source compound, here $TiCl_2$, dissolved in a molten salt phase, here $MgCl_2$, have formed dissolved product-source ions, here $Ti^{++}$, in molten $MgCl_2$. The $Ti^{++}$ has been reacted with a molten reductant metal, here magnesium, thereby forming titanium metal.

The formation of the titanium metal has taken place within a "zone of reaction" in which various forms of physical and chemical control can be arranged, seeking to vary and eventually guide the shape (but usually not the crystal structure) of crystals forming as titanium synthesis proceeds.

One method of control is to create a number of interchangeable structures that will alter the physical and chemical conditions wherein titanium metal forms—this may include changes of the thickness, shape, and character of the molten $MgCl_2$ phase holding $Ti^{++}$ ions as it passes by the molten magnesium and forms titanium deposits.

Thus, an arrangement as in FIG. 3 allows magnesium floating on $MgCl_2$ (free of $Ti^{++}$, which had reacted away) to come very close to the ceramic container—close, but not touching, however, because $MgCl_2$ wets both the ceramic and the molten magnesium, thus separating them. This is where the molten salt with $Ti^{++}$ squeezes through, pushing a little magnesium back from the ceramic wall, but bringing a thin film of molten salt with $Ti^{++}$ close to the magnesium. The result is that the system here has an arrangement that makes the reaction go well: Initially, $TiCl_2$ and magnesium can touch at the magnesium surface leading to forming Ti and $MgCl_2$. Apparently the magnesium has some wetting attraction to the titanium, as well as a chemical desire to exchange $Ti^{++}$ for $Mg^{++}$ (or $TiCl_2$ for $MgCl_2$). The immediate result is that the reactant $Ti^{++}$ ions are in the bulk of the molten salt and are not directly available to the magnesium. However, titanium needles will serve very well indeed to grow into the $Ti^{++}$-richer regions of the melt. As they get too large, however, the molten magnesium cannot hold the needles, and they fall offinto the molten salt below for collection as titanium product.

Experimental demonstration of needle crystal formation has been given for $UF_4$ solutions with molten magnesium in the inventor's laboratory. However, for the titanium example and other metals, the behavior is postulated.

Factors that may be useful in controlling the shape of crystal growth Include: (i) thickness and shape of the molten salt phase with product-source ions in contact with the molten reductant metal; (ii) the period of reactive exposure of the product-source ions with the molten reductant metal; (iii) the particle positions and orientations relative to the molten reductant metal's position; (iv) turbulence; (v) the nature of the three phase physical and chemical relationships that includes molten salt, molten reductant metal, and the inner surface of a container that holds the other two phases. This also includes the way the molten salt phase may wet and prevent intimate contact between the other phases and influence the flow of molten salt phase with product-source ions past the both the container wall and the molten reductant metal.

The influence of miniature electrochemical cells on the titanium synthesis reactions is of great importance as discussed previously; the effect of the needles in getting reaction into the bulk molten salt phase with product-source ions is critical to both general titanium synthesis and to needle production.

This invention is of interest with titanium, zirconium, hafnium, vanadium, niobium, tantalum, rhenium, molybdenum, tungsten, and uranium. However, the growth of special shapes of crystals appears also possible with a group of metals of industrial interest.

What I claim is:

1. An improved process for forming a desired product metal by molten salt-molten metal reaction comprising:

(a) providing a product-source compound that includes atoms of said desired product metal, said compound, if undecomposed, being little soluble in a selected molten salt phase, (b) providing said selected molten salt phase, (c) providing a first reductant material capable of reducing said product-source compound to a chemical form that is soluble in said selected molten salt, (d) interacting said product-source compound and said first reductant material in the presence of said selected molten salt to form dissolved product-source ions of said desired metal, (e) providing a molten reductant metal that can react to reduce said dissolved product-source ions to product-metal, (f) bringing said selected molten salt phase holding said dissolved product-source ions and said molten reductant metal into contact, thereby allowing said reducing reaction to form said product-source ions into said desired product metal, and (g) separating and recovering said desired product metal from said molten salt phase.

2. The process of claim 1 wherein said first reductant material comprises atoms in a chemical lower-valence form of the same element as comprise said desired product metal.

3. The process of claim 2 wherein said first reductant material comprises atoms of said chemical product atoms in zero-valence (metallic) state.

4. The process of claim 1 wherein said first reductant metal comprises different atoms than comprise said desired product metal.

5. The process of claim 1 wherein said desired product metal includes at least one member from the group consisting of titanium, zirconium, hafnium, vanadium, niobium, tantalum, rhenium, molybdenum, tungsten, and uranium.

6. The process of claim 1 wherein titanium is said desired product metal.

7. The process of claim 1 wherein uranium is said desired product metal.

8. The process of claim 1 wherein said dissolved product-source ions include ions from at least one member of the group consisting of halides of titanium, zirconium, hafnium, vanadium, niobium, tantalum, rhenium, molybdenum, tungsten, and uranium.

9. The process of claim 8 wherein titanium tetrachloride provides said dissolved product-source ions.

10. The process of claim 8 wherein uranium hexafluoride provides said dissolved product-source ions.

11. The process of claim 1 wherein said selected molten salt phase includes at least one element selected from the group consisting of Periodic Table Groups IA and IIA.

12. The process of claim 1 wherein said selected molten salt phase includes at least one halide.

13. The process of claim 1 wherein said dissolved product-source ions are introduced into said selected molten salt phase at least in part by reaction between (i) said product-source compound in the form of vapor of at least one halide of chemical higher valence of atoms of the same element as said desired product metal and (ii) said first reductant material that here comprises metal atoms of the same element as comprise said desired product metal, said reaction taking place at least in part in said molten salt phase between said vapor and said metal atom, both in contact with said selected molten salt phase.

14. The process of claim 1 wherein said first reductant material includes recycled metal comprising the same element as said desired product metal, leading, in consequence, to upgrading of said recycled metal.

15. The process of claim 1 wherein said first reductant material includes a form of Kroll product material comprising the same element as said desired product metal, leading in consequence to upgrading of said Kroll product material.

16. The process of claim 1, wherein said dissolved product-source ions in said molten salt phase may catalyze reactions to produce further dissolved product-source ions.

17. The process of claim 1 wherein said selected molten salt phase includes a chosen compound that will assist production of said desired product metal by providing improved solubility of said dissolved product-source ions in said selected molten salt phase.

18. The process of claim 1 wherein formation of complex ions increases the solubility of said dissolved product-source ions in said selected molten salt phase.

19. The process of claim 1 wherein said dissolved product-source ions are derived at least in part from impure product-source compounds.

20. The process of claim 1 wherein said dissolved product-source ions are purified relative to said impure product metal, which impure product metal is provided as a source of a portion of said dissolved product-source ions.

21. The process of claim 1 wherein impurity ions, including those associated with said impure product-source compounds, cannot pass through said selected molten salt phase holding dissolved product-source ions, particularly if said dissolved product-source ions are also in electrochemical contact with metallic atoms like those in said desired product metal, thereby rendering said impurity unable to move to contaminate said desired product metal.

22. The process of claim 1 wherein impurity ions, including those associated with said impure product metal, cannot pass through said selected molten salt phase holding dissolved product-source ions, particularly if said dissolved product-source ions are also in electrochemical contact with metallic atoms like those in said desired product metal, thereby rendering said impurity unable to move to contaminate said desired product metal.

23. The process of claim 1 wherein said dissolved product-source ions are reduced in part by hydrogen prior to reduction by said molten reductant metal.

24. The process of claim 1 wherein said product-source compound includes material in oxide form.

25. The process of claim 1 wherein said molten reductant metal includes at least one element from the Periodic Table Groups consisting of IA and IIA, plus aluminum and zinc.

26. The process of claim 1 wherein said molten reductant metal is magnesium.

27. The process of claim 1 wherein said molten reductant metal is in the form of a molten alloy.

28. The process of claim 1 wherein said desired product metal is, at least in part, in the form of needles.

29. The process of claim 1 wherein said desired product metal, at least in part, comprises single crystals.

30. The process of claim 1 wherein small particles of said desired product metal are grown larger.

31. The process of claim 1 wherein said recovered crystals of said desired product metal are provided a protective coating of cooled molten salt.

32. The process of claim 1 wherein said desired product metal is in molten form.

33. The process of claim 1 wherein said desired product metal is alloyed.

34. The process of claim 1 wherein said separation of said desired product metal from said selected molten salt phase includes later vacuum evaporation and removal of salt residues at elevated temperature.

35. The process of claim 1 operated continuously.

36. The process of claim 1 wherein said ionic molten salt solvent catalyzes said reaction between said purified gas and said reactant metal.

37. The process of claim 1 operated with joint reduction of more than one element provided as product-source ions.

38. The process of claim 1 wherein molten salt phase compositions are adjusted to remove excess by-product material by cooling cooling and freezing out some by-product.

39. The process of claim 1 wherein the excess by-product, at least in part, material freezes out along a thermodynamic liquidus surface.

40. The process of claim 1 wherein said by-product in said molten salt phase freezes out on a removable collector and removed.

41. The process of claim 1 wherein titanium ions are added to assure their presence at all times for catalysis.

42. A process for for making a desired physical form of crystalline product metal by molten salt-molten metal reaction comprising:

(a) providing a product-source compound that includes atoms of said desired product metal, said compound being soluble in a selected molten salt phase, (b) providing said selected molten salt phase, (c) dissolving said product-source compound in said selected molten salt phase to form dissolved product-source ions of said desired metal dissolved in said selected molten salt phase, (d) providing a molten reductant metal that can react to reduce said dissolved product-source ions to form said desired product-metal, (e) within a zone of reaction where said product metal atoms will form, providing physical and chemical conditions that will direct growth of said product metal atoms at least in part into crystals of a particular shape of product metal, (f) bringing said selected molten salt phase holding said dissolved product-source ions into contact with said molten reductant metal within a region that will provided said physical and chemical conditions that will direct growth of said product metal atoms being formed at least in part into said particular shape of product metal, and (g) separating and recovering said crystals of said particular shape of product metal from said molten salt phase.

43. The process of claim 42 wherein said providing physical and chemical conditions during said growth of said product metals results in the formation of particular shapes of product metal.

44. The process of claim 42 wherein the physical condition of said dissolved product-source ions as they flow as a film over molten magnesium helps provide a configuration that aids in formation of particular shapes of a desired crystalline product metal.

45. The process of claim 42 wherein flow of said dissolved product-source ions in said molten salt phase past a reactive surface of molten reductant metal is controlled at least in part by the shape of a zone of reaction, which shape helps to establish crystal growth shaping factors including (i) the thickness and shape of said phase holding said dissolved product-source ions as these ions pass by, and react with, said molten reductant metal, (ii) the period of reactive exposure, (iii) the product metal particle positions and orientations relative to said molten reductant metal, and (iv) the turbulence.

46. The process of claim 45 wherein said zone of reaction includes a three-phase region that comprises (i) a phase that provides containment, (ii) a region of molten salt phase, (iii) a molten reductant metal suspended on said molten salt phase wherein said dissolved product-source ions added from above flow by said molten reductant metal, at least in part, in a thin layer of molten salt in close contact with said molten reductant metal layer.

47. The process of claim 46 wherein said suspension is by floating.

48. The process of claim 46 wherein metallic needles are produced.

49. The process of claim 48 wherein uranium needles are produced.

50. The process of claim 42 wherein the physical and chemical conditions allow occurrence of temporary miniature electrochemical cells in said molten salt phase that, at least in part, create a desired crystalline product metal shape.

51. The process of claim 42 wherein said formation of individual neeedles provides a physical shape essential in formation of said miniature electrochemical cells.

52. The process of claim 42 wherein the metal with a desired crystalline product shape includes at least one member from the group consisting of titanium, zirconium, hafnium, vanadium, niobium, tantalum, rhenium, molybdenum, tungsten, and uranium.

* * * * *